US012214846B2

(12) United States Patent
Grall

(10) Patent No.: US 12,214,846 B2
(45) Date of Patent: Feb. 4, 2025

(54) CLEAT FOR MOORING A WATERCRAFT, AND MOORING ASSEMBLY HAVING A CLEAT AND A LINE HAVING A STOPPER

(71) Applicant: IXBLUE, Saint-Germain-en-Laye (FR)

(72) Inventor: Sébastien Grall, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 462 days.

(21) Appl. No.: 17/771,942

(22) PCT Filed: Oct. 27, 2020

(86) PCT No.: PCT/EP2020/080161
§ 371 (c)(1),
(2) Date: Apr. 26, 2022

(87) PCT Pub. No.: WO2021/083883
PCT Pub. Date: May 6, 2021

(65) Prior Publication Data

US 2022/0371692 A1 Nov. 24, 2022

(30) Foreign Application Priority Data

Oct. 29, 2019 (FR) ..... 1912113

(51) Int. Cl.
*B63B 21/04* (2006.01)
*B63B 21/20* (2006.01)

(52) U.S. Cl.
CPC ..... *B63B 21/04* (2013.01); *B63B 21/20* (2013.01); *B63B 2021/203* (2013.01)

(58) Field of Classification Search
CPC ... B63B 21/04; B63B 21/20; B63B 2021/203; B63B 21/08; B63B 2027/165; B63B 2035/007; B63G 2008/004
See application file for complete search history.

(56) References Cited

U.S. PATENT DOCUMENTS 554,228 A * 2/1896 Beckwith ..... B68B 5/02 54/30
1,901,050 A * 3/1933 Vorhees ..... B65H 75/06 242/407

(Continued)

FOREIGN PATENT DOCUMENTS

| | | |
|---|---|---|
| EP | 0 169 781 | 1/1986 |
| FR | 2994560 | 2/2014 |
| WO | 2014/086336 | 6/2014 |

OTHER PUBLICATIONS

International Search Report for PCT/EP2020/080161, mailed Jan. 28, 2021, 6 pages.

(Continued)

*Primary Examiner* — Andrew Polay
(74) *Attorney, Agent, or Firm* — NIXON & VANDERHYE

(57) ABSTRACT

A cleat for mooring a watercraft at a thrown end of a line has a base surmounted by a body, the base being fastenable to a watercraft deck, the line having a rope and stopper formed by a transverse protuberance, the cleat having an engagement part adjoining the base and a funnel-shaped through-opening to an elongate slot in the body, the slot having a height allowing the longitudinal progression and transverse passage of the rope from the opening towards the interior of the body, the slot leading into a chamber having a minimum dimension greater than the minimum slot height, the maximum dimension of the chamber being less than the dimension of the protuberance forming the stopper so the stopper of a line passing transversely through the body can be blocked against a the body side face both with the rope in the slot and in the chamber.

20 Claims, 5 Drawing Sheets

(56) References Cited

U.S. PATENT DOCUMENTS

| | | | | |
|---|---|---|---|---|
| 3,126,858 | A * | 3/1964 | Rosinski | B63B 21/045 138/122 |
| 3,757,722 | A | 9/1973 | Seiple | |
| 3,879,812 | A * | 4/1975 | Clinch | F16B 45/008 24/698.2 |
| 3,897,745 | A * | 8/1975 | Hutchings | B63B 21/045 114/218 |
| 4,173,194 | A * | 11/1979 | McLaughlin | B63B 21/08 174/175 |
| 5,396,859 | A | 3/1995 | Hillenbrand et al. | |
| 5,398,636 | A | 3/1995 | Hillenbrand | |
| 6,904,861 | B1 | 6/2005 | Warner et al. | |

OTHER PUBLICATIONS

Written Opinion of the ISA for PCT/EP2020/080161, mailed Jan. 28, 2021, 5 pages.

* cited by examiner

CLEAT FOR MOORING A WATERCRAFT, AND MOORING ASSEMBLY HAVING A CLEAT AND A LINE HAVING A STOPPER

This application is the U.S. national phase of International Application No. PCT/EP2020/080161 filed Oct. 27, 2020, which designated the U.S. and claims priority to FR Patent Application No. 1912113 filed Oct. 29, 2019, the entire contents of each of which are hereby incorporated by reference.

TECHNICAL FIELD

The present invention generally relates to the field of navigation and ships and floating crafts and, more particularly, to a watercraft mooring cleat. The invention also relates to a mooring assembly with cleat and stopper line. It has applications in particular in the field of shipbuilding.

TECHNOLOGICAL BACKGROUND

Thanks to technical progress, in particular in electronics and computer science, it becomes possible to automate many operations such as sea or underwater exploration with autonomous, i.e. unmanned watercrafts. It is however necessary to be able to recover these watercrafts, for example for servicing, whereas they are at sea, and it is thus necessary to be able to moor them to a ship that will tow them or raise them on board, according to the case. For that purpose, a line must be installed between the ship and the watercraft, and attached to both. If this is not a problem on the ship side, where a crew is able to carry out the operation on the ship, this is more difficult on the watercraft side, due to the fact that there is nobody to recover the line coming from the ship and attach it to the watercraft.

It may be required to send a diver to recover the line and attach it to the watercraft, or a pole may be used to catch the watercraft. However, the surface of the sea is not stable because of swell, winds . . . and the watercraft recovery by a diver may be impossible or lead to collisions between the ship and the watercraft because a pole cannot be very long.

The present invention proposes a solution that makes it possible to moor almost-automatically a watercraft following a line throw to the watercraft to "hook"/"remotely catch" the latter, then to bring it back or to tow it. The present invention therefore proposes a solution making it possible to moor to the watercraft without mounting on board and without having to approach closer than a reasonable distance.

In this field, mooring systems are known from the documents: FR 2 994 560 A1, U.S. Pat. No. 3,757,722 A, WO 2014/086336 A1 and U.S. Pat. No. 5,398,636 A.

The invention is consisted of a plate made of metal or another resistant-enough material, which is here called cleat, but which could also be called "towing chain plate". This plate is equipped with an attachment means adapted to the watercraft on which is it fitted, typically a base serving for attachment to the watercraft. Moreover, the line has, at its thrown end, a stopper or retainer, preferably liable to constitute a weight that will further allow increasing the throw distance.

DISCLOSURE OF THE INVENTION

It is first proposed according to the invention, a cleat for mooring a watercraft to a thrown end of a line including a rope and at least one stopper, the thrown end of the line comprising the stopper formed by a transverse protuberance across the rope, the cleat including a base surmounted with a body elongated in a main plane and narrow in a direction transverse to the main plane and having two lateral faces, the base being adapted to be fastened to a deck of the watercraft, in such a way that the main plane of the body is substantially vertical when the watercraft is in water, the cleat including an engagement part at a longitudinal end of the body, the engagement part adjoining the base and including a through-opening of a slot for the passage of the rope, the slot extending longitudinally towards the interior of the body and being open on the two lateral faces of the body, the slot having an upper face and a lower face and having a height allowing the longitudinal progression and the transverse movement of the rope, except for the stopper, within the slot from the through-opening towards the interior of the body, said rope being then arranged transversely across the body between the two lateral faces of the body, the through-opening having an outwardly flared shape so as to form a funnel for guiding the rope towards the interior of the slot, within the body, the slot leading to a chamber open on the two lateral faces of the body, the chamber having a minimum size, measured in the main plane of the body, that is greater than the minimum height of the slot, the maximum size of the chamber, measured in the main plane of the body, being smaller than the size of the stopper-forming protuberance, measured transversely to the rope in such a way that the stopper of a line moving transversely across the body can be blocked against a lateral face of the body, both when the rope is engaged in the slot and when the rope is engaged in the chamber.

Other non-limiting and advantageous features of the cleat according to the invention, taken individually or according to all the technically possible combinations, are the following:

- the minimum height of the slot is slightly greater than the rope diameter,
- the minimum height of the slot is smaller than twice the rope diameter,
- the minimum height of the slot is between 4 mm and 40 mm,
- the maximum size of the chamber is between 6 mm and 200 mm,
- the deck is a surface of the watercraft that is directed upward and accessible to a thrown line,
- the size of the stopper-forming protuberance measured transversely to the rope is the maximum size of said stopper,
- the stopper-forming protuberance is at least one rod transverse to the rope,
- the stopper-forming protuberance is star-shaped, circular-shaped or ball-shaped,
- the stopper-forming protuberance is at least one knot of the rope,
- the stopper-forming protuberance is arranged towards the thrown end of the rope,
- the stopper-forming protuberance further forms a weight,
- the cleat is a carabiner cleat, the slot having, on at least one of its two upper and lower faces, a tilting ramp elastically retractable under the pressure of a rope progressing on the ramp at least towards the chamber, the slot having, at the ramp and in the absence of pressure of the rope on the ramp, a height smaller than the diameter of the rope, the retraction of the ramp under the rope pressure causing an increase of height of the slot at the ramp and allowing the progression of the rope towards at least the chamber, the slot height at the ramp, in the absence of rope pressure on the ramp, which is smaller than the rope diameter, is not understood as being the minimum height of the slot for the relationships between the slot and chamber sizes, the tilting ramp is configured so as to retract only for a rope progressing towards the chamber but not in the reverse direction, the rope being then able to progress along the slot, from the through-opening towards the chamber, but not in the other direction, the tilting ramp comprises a manual retraction-control device intended to allow the rope progression along the slot from the chamber towards the through-opening to manually bring the line out of the cleat, the tilting ramp retraction command is remote-controlled, the cleat is made of two body parts manually articulated to each other, forward-articulated upper part and lower part allowing the slot and chamber height to be manually enlarged, the cleat being then in open position, in order to make the stopper pass through the spaced apart body without having to make the rope pass again from the chamber and the slot towards the engagement part, the two articulated upper and lower parts of the body comprise a lock in non-open position, said lock being removable, in non-open position, the cleat is active and able to catch a line, in open position, the cleat is inactive and is not able to catch a line, the tilting ramp forms the lower face of the slot, the tilting ramp forms the upper face of the slot, the cleat has two tilting ramps arranged facing each other and forming the two upper and lower faces of the slot, the tilting ramp forming the lower face of the slot is inclined from the bottom and the through-opening towards the top and the chamber, the tilting ramp forming the upper face of the slot is inclined from the top and the through-opening towards the bottom and the chamber, the tilting ramp is consisted of a non-articulated flexible metal blade, the non-articulated tilting ramp(s) have two opposite longitudinal ends and are fastened towards their through-opening side end, the articulated tilting ramp is consisted of a substantially rigid metal blade coming against a spring that is compressed during the retraction, the articulated tilting ramp(s) have two opposite longitudinal ends and are articulated towards their through-opening side end, the cleat is consisted of corrosion-resistant metal parts, particularly resistant to sea water, the slot has a substantially constant height along its path and follows either a horizontal path or an inclined path from the bottom and the through-opening towards the top and the interior of the body, or a sinuous path with an intermediate apex, the slot opens to an upper part of the chamber, the upper and lower faces of the slot are ended by upper and lower protuberances entering the chamber, the cleat has a rounded upper edge whose anterior end, opposite to the posterior end on the engagement part side, joins the base, and whose posterior end, on the engagement part side, is extended by a spur, more on the rear and above the engagement part.

The invention also relates to a mooring assembly including a cleat according to the invention and a line including a rope and a stopper consisted of at least one transverse protuberance on the periphery of the rope.

Other non-limiting and advantageous features of the mooring assembly according to the invention, taken individually or according to all the technically possible combinations, are the following:

the stopper is a heavy stopper, the stopper is a heavy ball, the heavy ball is magnetized and the cleat is made of a metal material attracting the magnetized heavy ball, the rope is made of a flexible, synthetic material, the anterior end of the cleat is directed towards the watercraft bow, the deck includes a line receiving part on the rear of the posterior end of the cleat, the receiving part is inclined from the top and the rear towards the bottom and the front in such a way that the rope moves down by gravity towards the receiving part of the cleat, the inclined receiving part is a taut cable.

The invention also relates to a method for mooring a watercraft to a thrown end of a line, a cleat according to the invention being implemented on the watercraft and a stopper being implemented at the end of the line formed of a rope and said end stopper. During this mooring operation, the watercraft may be put at a standstill or be inert and therefore no longer actively moving. This standstill has to be considered in the sea context and can correspond to the fact that said watercraft is subject to sea current and/or wind and can drift somewhat if this current and/or wind is/are relatively strong. In other cases, if the watercraft includes fixed place positioning means for countering the effects of current and wind, then this standstill corresponds to an immobilization in a fixed place. That is the rope that is thrown towards the watercraft, and there is no need for the watercraft to actively come and intercept the rope. It results therefrom that there is no need for the rope to have a positive buoyancy to stay at the water surface because the rope is thrown to the watercraft. The system of the invention works with any type of rope and this is the person who uses the rope, and possibly the towing ship on which he is, who carries out all the actions and potentially trajectories that allow the watercraft mooring and recovery. The rope can be thrown manually or using a throwing device.

DETAILED DESCRIPTION OF AN EXEMPLARY EMBODIMENT

The following description in relation with the appended drawings, given by way of non-limiting examples, will allow a good understanding of what the invention consists of and of how it can be implemented.

In its generality, the present invention relates to a cleat that has such a geometry that a line sent remotely and more or less perpendicular to the cleat will be "caught" as soon as a traction towards the front of the cleat will be applied to the line, to pull on the line. The line automatically slides in the cleat like in a spinning machine. The line is equipped with a voluminous end, a stopper, which is typically a toulin apple, so as to get stuck in the cleat and to hence allow the mooring of the watercraft.

In its simplest version, the cleat is totally inert/passive, as shown in FIGS. 1 to 5. In a more advanced version, the cleat includes at least one mobile part, in particular at least one retractable tilting ramp, or an articulated spring finger, which works like a carabiner.

In another advanced version, the towing chain plate may be equipped with a catch securing device, i.e. a device allowing the catching/hooking of the line but not the extraction/unhooking like a movable actuator, in particular of the hydraulic, pneumatic or electric type.

It may also be provided that the cleat can be placed in two stable states, an active state allowing the line to be caught and hooked, and an inactive state in which the line cannot be hooked, and no mooring can take place by a simple throw of the line as permitted in the active state.

Figure 1:
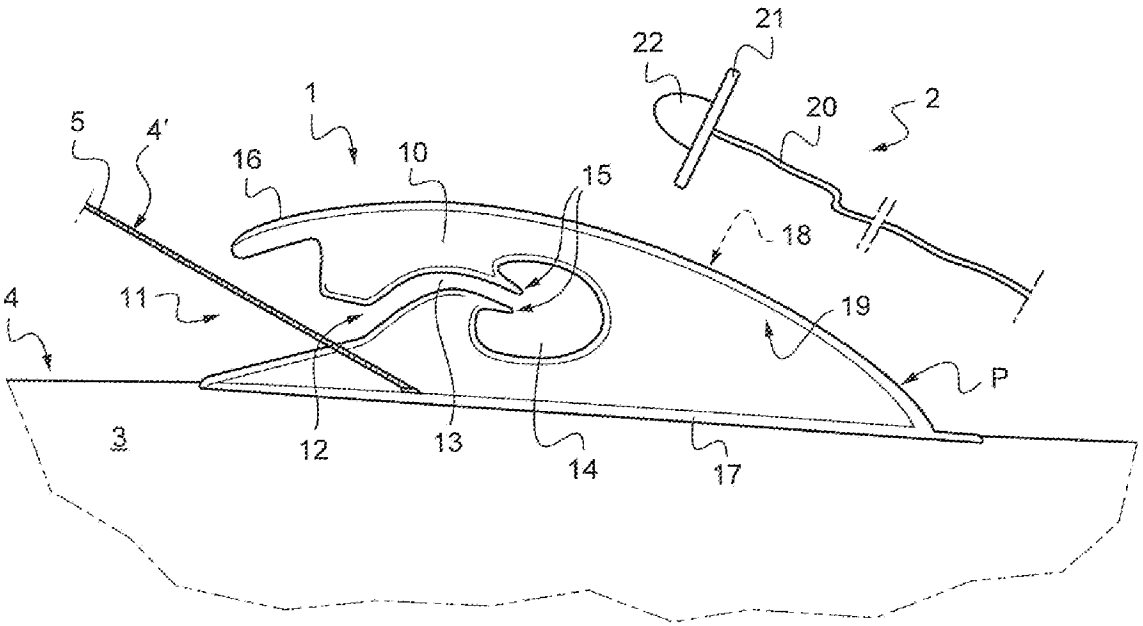
FIG. 1 shows a lateral view of a cleat with a convoluted slot and a line with a stopper.

FIG. 1 shows a cleat of a simple embodiment. This embodiment is said simple because the holding of the line in the cleat is obtained passively contrary to embodiments in which retractable devices, in particular a retractable ramp, are implemented. In the simple mode, the force of gravity and particular shapes of the elements are used to make it very difficult, if not almost impossible, for the rope to exit from the cleat body once the rope has entered the cleat body, without any direct human intervention necessary to unmoor the watercraft.

The line 2 used to hook and moor the watercraft includes a rope 20 and a stopper 21 at its thrown end.

The cleat 1 comprises a base 17 surmounted with an elongated narrow vertical body 10 having two lateral faces 18, 19 defining a longitudinal main plane. The base 17 is intended to be fastened to the deck 3 of a watercraft 6. The cleat 1 comprises, at the rear of the body, an engagement part 11 adjoining the base and including a through-opening 12 of a slot 13, the through-opening 12 being funnel-shaped. The slot 13 extends towards the interior of the body 10 and opens to a chamber 14 of the body. This funnel shape is actually reduced to the thickness of the body and its upper and lower faces are substantially flat. This is to facilitate the introduction of the rope 20 of the line 2 into the slot 13 that the through-opening 12 at the entrance of the slot 13, on the engagement part 11 side, has a rearward flared shape by forming a kind of funnel for guiding the rope 20 into the slot 13 and the interior of the body 10 of the cleat 1.

The rope 20 can progress longitudinally along the slot 13 towards the chamber 14 and can also move transversely in the slot 13 and the chamber 14.

The cleat 1 has a rounded upper edge whose anterior end, opposite to the posterior end, on the engagement part 11 side, joins the base 17. The posterior end of the upper edge of the cleat, on the engagement part 11 side, is extended by a spur 16, more on the rear and above the engagement part 11.

Figure 5:
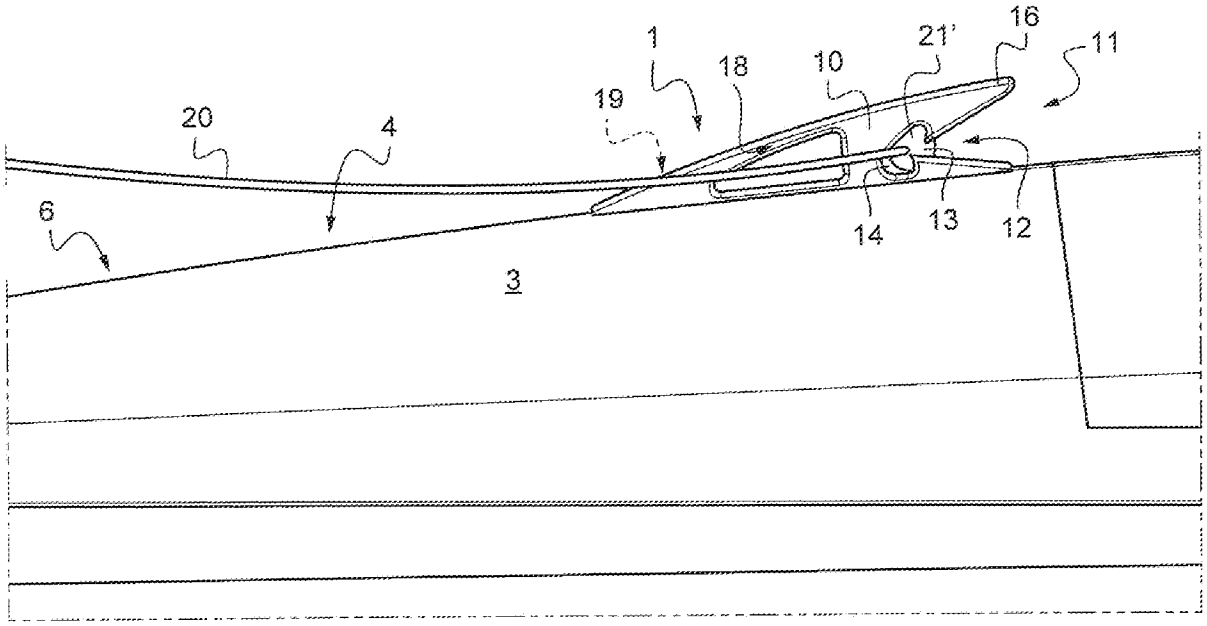
FIG. 5 shows a perspective view corresponding to the state of FIG. 4, but on the opposite lateral side of the watercraft.

The rope 20 can hence have two possibly combined movements with respect to the cleat 1: on the one hand, a longitudinal progression, the rope 20 moving from the engagement part to the chamber or, in the reverse direction, and on the other hand, a transverse movement, the rope 20 being pulled laterally through the cleat body 10 to bring closer to the cleat 1 the stopper end 21 that will end up blocked against a lateral face 18, 19 (in the figures showing lateral or side views, the non-visible lateral face, 18 in FIG. 1 or 19 in FIG. 5, is indicated by a dashed arrow) of the body 10.

Moreover, the rope 20 being passed inside the chamber 14, it will be difficult for it to come back into the slot without direct human intervention, in particular if the slot 13 opens to a high point of the chamber 14 and/or includes upper and lower protuberances 15 engaging into the chamber 14. Moreover, if the slot 13 is convoluted with a high point and/or if it has, on at least one of its two faces, a retractable tilting ramp allowing the progression of the rope 20 only towards the chamber, the exit of the line out of the cleat will hence be made far more difficult, and even impossible, without human intervention.

The rope 20 is flexible and can be thrown remotely, on the deck 3 of the watercraft to be recovered and moored. The line 2 includes a stopper 21 at its thrown end. In the figure, the stopper 21 is distinct from the end weight 22 of the line 2 but, in other embodiments, the stopper 21' is also a weight, and is then a heavy stopper 21'. The weight (22) makes it possible to increase the throwing impulse and therefore to send the thrown end of the line 2 further.

The line 2 has to be able to be blocked in the cleat 1 and that is for that reason that it has, towards its thrown end, a stopper 21 that constitutes a protuberance that is transverse/perpendicular to the line, at least bilateral to the rope 20 or circular around the rope 20. This stopper 21 has a transverse size, length or diameter, greater than the greatest height size of the slot 13 and of the chamber 14, in order to be able to be blocked against a lateral face 18, 19 of the body 10 of the cleat 1 once the rope 20 has moved transversely through the body 10 until the stopper 21 meat the cleat 1. In the case where the stopper is a simple bilateral protuberance of the straight rod type, if the slot 13 has a rectilinear portion, the latter is arranged to be shorter than the protuberance 21 to avoid that the latter can escape from the cleat when it is aligned with and inside the rectilinear portion. To avoid this, a convoluted slot can be formed or a protuberance with at least three arms radially distributed about the rope 20 can be provided. Preferably, it is provided at the thrown end of the line 2 a ball that forms both a protuberance and a weight that will come to block against a lateral face 18, 19 of the body 10 of the cleat 1.

For the mooring, the end of the line 2 that has a stopper 21 is thrown above the line receiving part 4, 4' that is located on the rear of the posterior end of the cleat 1 in such a way that the rope 20 falls onto this receiving part 4, 4' whereas the stopper 21 falls far beyond the cleat 1. This receiving part 4 may correspond to the watercraft deck 3 itself. This receiving part 4' may correspond to an inclined cable 5 that will allow the rope 20 to easily slide towards the engagement part 11 of the cleat 1 because of the force of gravity. In order to make the rope 20 enter the slot, it is understood that a traction has to be exerted on the rope 20 obliquely to the body 10 of the cleat 1, essentially towards the front of the cleat 1.

The orientation of the main plane of the body 10 of the cleat 1 with respect to the main front/bow-rear/stern axis of the watercraft 6 may depend on the intended use of the mooring. If only towing is planned then it is preferable that the cleat 1 is installed with its body in a vertical direction, along the main axis of the watercraft 6, on the deck 3, and with the main axis of the watercraft in the main plane P of the body 10 of the cleat 1 or with a slight angle between them. If the use is simply to bring the watercraft 6 edge-to-edge with a ship or a pontoon, the cleat can be arranged on a lateral edge of the deck 3 of the watercraft 6. The engagement part 11, with its through-opening 12, is preferably oriented in the opposite direction from where the line 2 is to be pulled for the rope to be caused to enter the slot 13 and the chamber 14 when the line will be pulled after having been thrown and after it will have fallen onto the deck 3, on the rear of the cleat 1.

In the case of a cleat with tilting ramp(s), this ramps, or the two opposite tilting ramps, form typically the funnel part of the through-opening 12 at the entrance of the slot 13.

Figure 2:
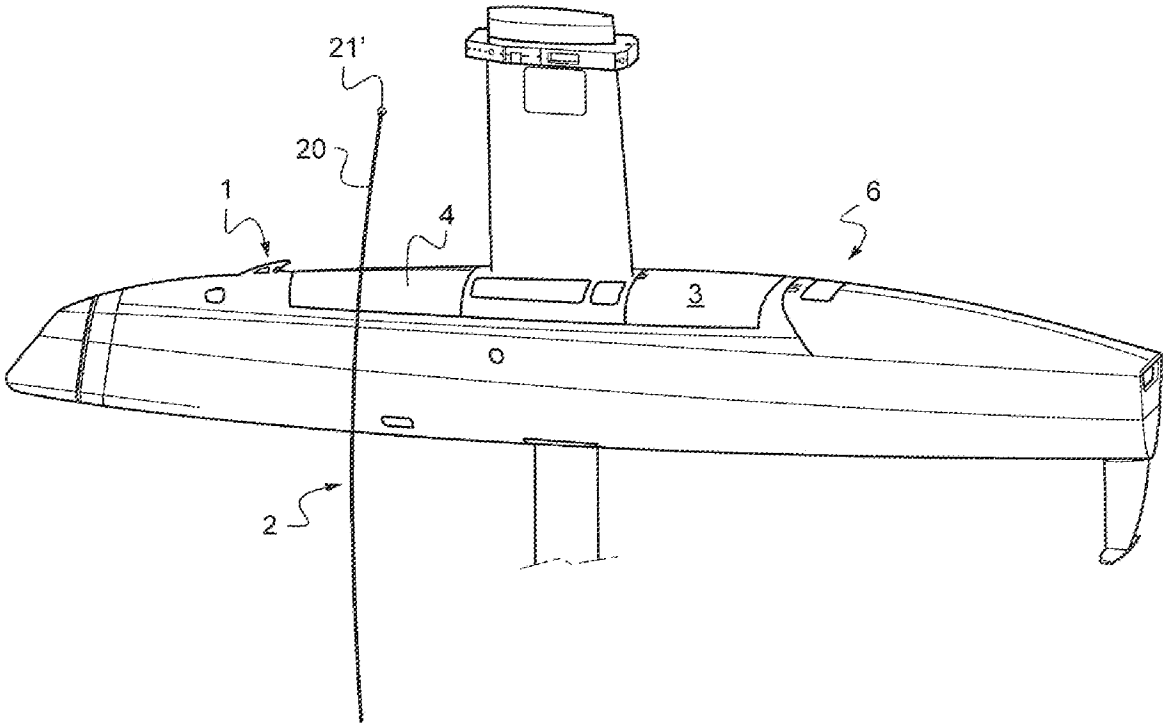
FIG. 2 shows a perspective view of a first lateral side of a partially shown watercraft, having a cleat on its deck, towards the front, and towards which a line with an end stopper has just been thrown.

In FIG. 2, the watercraft 6 is viewed from a lateral side with its bow/front on the left in the figure. The cleat 1 is fastened to the deck 3, above the waterline, towards the front of the watercraft 6. It is to be noted that the mooring assembly with cleat and line of the invention could work under water, given the weight of the line end, and that the line rope could be made submersible or be submersible.

In FIG. 2, the line end that has the heavy/weighted stopper 21' has just been thrown above the line receiving part 4 of the deck 3 and the heavy stopper 21' has gone beyond the watercraft and will fall in the water or at least on the other side of the cleat 1 with respect to the side of throwing of the line 2.

Figure 3:
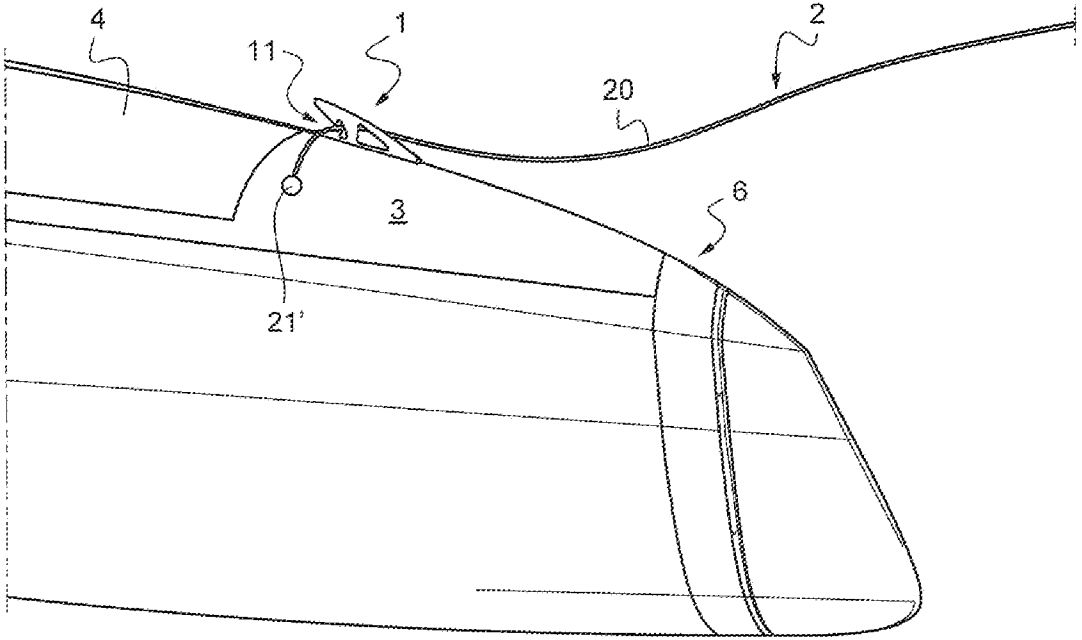
FIG. 3 shows a perspective view of the front of the watercraft deck, on the lateral side opposite to that of FIG. 2, the line having fallen on the deck and having begun to be pulled towards the front of the watercraft.
Figure 4:
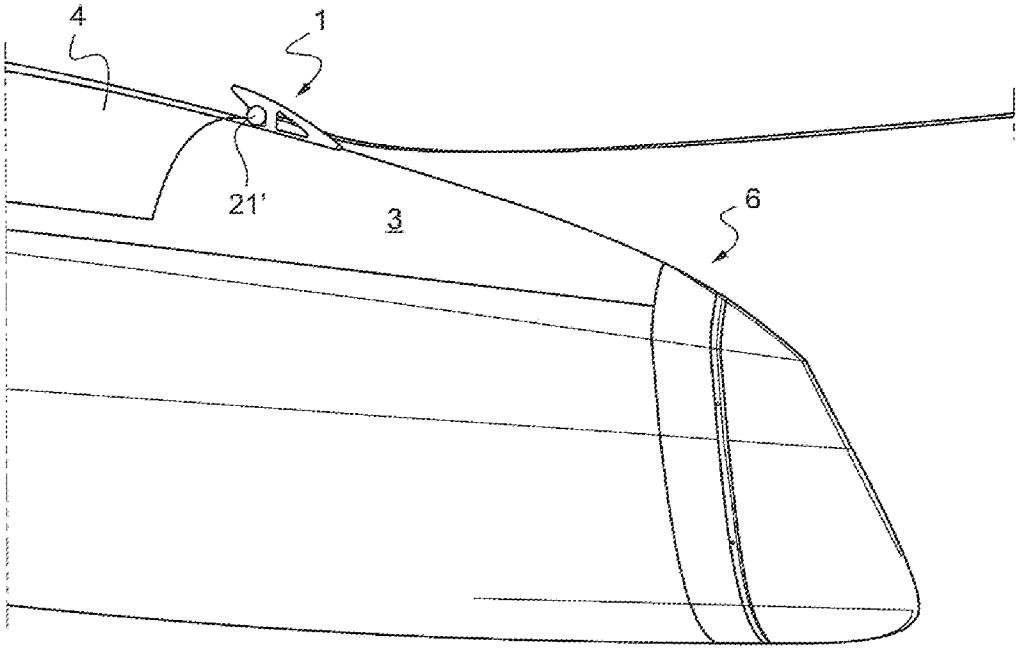
FIG. 4 shows the perspective view of FIG. 3, but with the line fully pulled, and caught and blocked in the cleat by the stopper.

In FIG. 3, the line 2 having fallen onto the watercraft 6, the line 2 has begun to be pulled forward or forward and laterally, on the throw side, which has brought the line 2 towards the engagement part 11 of the cleat 1, and has moved the heavy stopper 21' closer to the cleat.

The continued traction on the line will make the rope 20 pass into the chamber 14, in which it will be caught. This state corresponds to FIGS. 4 and 5, in which the heavy stopper 21' has come against a lateral face 19 of the body 10 of the cleat 1. In FIG. 5, it may be observed that the slot 13 has been reduced to its simplest expression and corresponds to the funnel-shaped through-opening 12.

To unmoor the watercraft, the rope is made pass manually, in the reverse direction, within the slot to be brought out by the way it came in. In alternative embodiments, a cleat is implemented, whose body is made of two upper and lower parts articulated to each other, like a guillotine (the upper part can be lifted as a whole) or a clamp (the upper and lower parts are articulated to each other at the front of the cleat), which widens the slot and the chamber and make the line and its stopper directly pass from one side of the body to the other, and hence releases the line. These alternatives allow automating the line release, in particular by remote-control. It may for example be provided that the clamp alternative includes a spring biasing the upper part in open configuration, the cleat being manually closed against the spring force and removably locked in closed configuration, in particular by remote-control. In an alternative embodiment, the chamber 14 and the stopper 21, 21' have complementary shapes allowing the partial introduction of the stopper into the chamber through the cleat body, which may increase the line holding capacity of the cleat.

The invention claimed is:

1. A cleat capable of mooring a watercraft to a thrown end of a line including a rope and at least one stopper, the thrown end of the line comprising the stopper formed by a transverse protuberance across the rope, the cleat including a base surmounted with a body elongated in a main plane and narrow in a direction transverse to the main plane and having two lateral faces, the base being adapted to be fastened to a deck of the watercraft, in such a way that the main plane of the body is substantially vertical when the watercraft is in water, the cleat including an engagement part at a longitudinal end of the body, the engagement part adjoining the base and including a through-opening of a slot for the passage of the rope, the slot extending longitudinally towards the interior of the body and being open on the two lateral faces of the body, the slot having an upper face and a lower face and having a height allowing the longitudinal progression and the transverse movement of the rope, except for the stopper, within the slot from the through-opening towards the interior of the body, said rope being then arranged transversely across the body between the two lateral faces of the body, the through-opening having an outwardly flared shape so as to form a funnel for guiding the rope towards the interior of the slot, within the body, the slot leading to a chamber open on the two lateral faces of the body, the chamber having a minimum size, measured in the main plane of the body, that is greater than the minimum height of the slot, the maximum size of the chamber, measured in the main plane of the body, being smaller than the size of the stopper-forming protuberance, measured transversely to the rope in such a way that the stopper of a line moving transversely across the body can be blocked against a lateral face of the body, both when the rope is engaged in the slot and when the rope is engaged in the chamber, wherein the upper and lower faces of the slot are ended by upper and lower protuberances entering the chamber.

2. The cleat according to claim 1, wherein the cleat is a carabiner cleat, the slot having, on at least one of the two upper and lower faces, a tilting ramp elastically retractable under the pressure of a rope progressing on the ramp at least towards the chamber, the slot having, at the ramp and in the absence of pressure of the rope on the ramp, a height smaller than the diameter of the rope, the retraction of the ramp under the rope pressure causing an increase of height of the slot at the ramp and allowing the progression of the rope towards at least the chamber.

3. The cleat according to claim 2, wherein the tilting ramp is configured so as to retract only for a rope progressing towards the chamber but not in the reverse direction, the rope being then able to progress along the slot, from the through-opening towards the chamber, but not in the other direction.

4. The cleat according to claim 3, wherein the tilting ramp comprises a manual retraction-control device intended to allow the progression of the rope along the slot from the chamber towards the through-opening to manually bring the line out of the cleat.

5. The cleat according to claim 2, wherein the tilting ramp forms the lower face of the slot.

6. The cleat according to claim 1, wherein the slot has a substantially constant height along the slot's path and follows either a horizontal path or an inclined path from the bottom and the through-opening towards the top and the interior of the body, or a sinuous path with an intermediate apex, and wherein the slot opens to an upper part of the chamber.

7. The cleat according to claim 1, wherein the slot opens to an upper part of the chamber.

8. The cleat according to claim 1, wherein the cleat has a rounded upper edge whose anterior end, opposite to the posterior end, on the engagement part side, joins the base, and whose posterior end, on the engagement part side, is extended by a spur, more on the rear and above the engagement part.

9. A mooring assembly including a cleat according to claim 1 and a line including a rope and a stopper comprising at least one transverse protuberance on the periphery of the rope.

10. A mooring assembly comprising the cleat of claim 1 and a line including a rope and a stopper comprising at least one transverse protuberance on the periphery of the rope, wherein the stopper is a heavy ball.

11. The cleat according to claim 3, wherein the tilting ramp forms the lower face of the slot.

12. The cleat according to claim 4, wherein the tilting ramp forms the lower face of the slot.

13. The cleat according to claim 2, wherein the slot opens to an upper part of the chamber.

14. The cleat according to claim 6, wherein the slot opens to an upper part of the chamber.

15. The cleat according to claim 12, wherein the slot opens to an upper part of the chamber.

16. The cleat according to claim 2, wherein the cleat has a rounded upper edge whose anterior end, opposite to the posterior end, on the engagement part side, joins the base, and whose posterior end, on the engagement part side, is extended by a spur, more on the rear and above the engagement part.

17. The cleat according to claim 6, wherein the cleat has a rounded upper edge whose anterior end, opposite to the posterior end, on the engagement part side, joins the base, and whose posterior end, on the engagement part side, is extended by a spur, more on the rear and above the engagement part.

18. The cleat according to claim 15, wherein the cleat has a rounded upper edge whose anterior end, opposite to the posterior end, on the engagement part side, joins the base, and whose posterior end, on the engagement part side, is extended by a spur, more on the rear and above the engagement part.

19. The cleat according to claim 3, wherein the tilting ramp forms the lower face of the slot.

20. The cleat according to claim 4, wherein the tilting ramp forms the lower face of the slot.

* * * * *